US011517486B2

(12) United States Patent
Plass

(10) Patent No.: US 11,517,486 B2
(45) Date of Patent: Dec. 6, 2022

(54) MULTI-FUNCTIONAL STRETCHER

(71) Applicant: Plass Medtech AG, Zurich (CH)

(72) Inventor: André Plass, Zurich (CH)

(73) Assignee: PLASS RESCUE TECHNOLOGIES AG, Stetten (CH)

( * ) Notice: Subject to any disclaimer, the term of this patent is extended or adjusted under 35 U.S.C. 154(b) by 299 days.

(21) Appl. No.: 16/307,451

(22) PCT Filed: Jun. 8, 2017

(86) PCT No.: PCT/EP2017/064049
§ 371 (c)(1),
(2) Date: Dec. 5, 2018

(87) PCT Pub. No.: WO2017/212001
PCT Pub. Date: Dec. 14, 2017

(65) Prior Publication Data

US 2019/0192360 A1 Jun. 27, 2019

(30) Foreign Application Priority Data

Jun. 8, 2016 (CH) ..... 729/16
Jun. 8, 2017 (WO) ..... PCT/EP2017/064049

(51) Int. Cl.
*A61G 1/048* (2006.01)
*A61G 1/013* (2006.01)

(52) U.S. Cl.
CPC ..... *A61G 1/048* (2013.01); *A61G 1/013* (2013.01)

(58) Field of Classification Search
CPC ..... A61G 1/04; A61G 1/048; A61G 1/013; A61G 1/00
See application file for complete search history.

(56) References Cited

U.S. PATENT DOCUMENTS 1,164,828 A 12/1915 Luria
5,263,213 A * 11/1993 Robertson ..... A61G 1/00 5/601
5,494,051 A * 2/1996 Schneider, Sr. ..... A61G 1/00 128/870
5,918,331 A * 7/1999 Hall ..... A61G 1/04 5/626
6,175,977 B1 * 1/2001 Schumacher ..... A61G 1/04 128/845
7,671,299 B2 * 3/2010 Gifford ..... B62J 33/00 219/204

(Continued)

FOREIGN PATENT DOCUMENTS

EP 0400760 A1 12/1990
WO 1995020933 A1 8/1995

OTHER PUBLICATIONS

PCT/EP2017/064049 filed Jun. 8, 2017 International Search Report and Written Opinion dated Aug. 21, 2017.

*Primary Examiner* — Eric J Kurilla
*Assistant Examiner* — Amanda L Bailey
(74) *Attorney, Agent, or Firm* — Rutan & Tucker LLP

(57) ABSTRACT

A stretcher (1) for transporting individuals (2) requiring medical care, comprising main bars (11) and a collapsible lying surface (12) arranged between the main bars (11), wherein the main bars (11) comprise at least one accommodation compartment for accommodating medical instrumentation (114, 1141, 1142, 1143, 1144, 115, 116) and/or drugs.

16 Claims, 2 Drawing Sheets

(56) References Cited

U.S. PATENT DOCUMENTS

Figure 1:
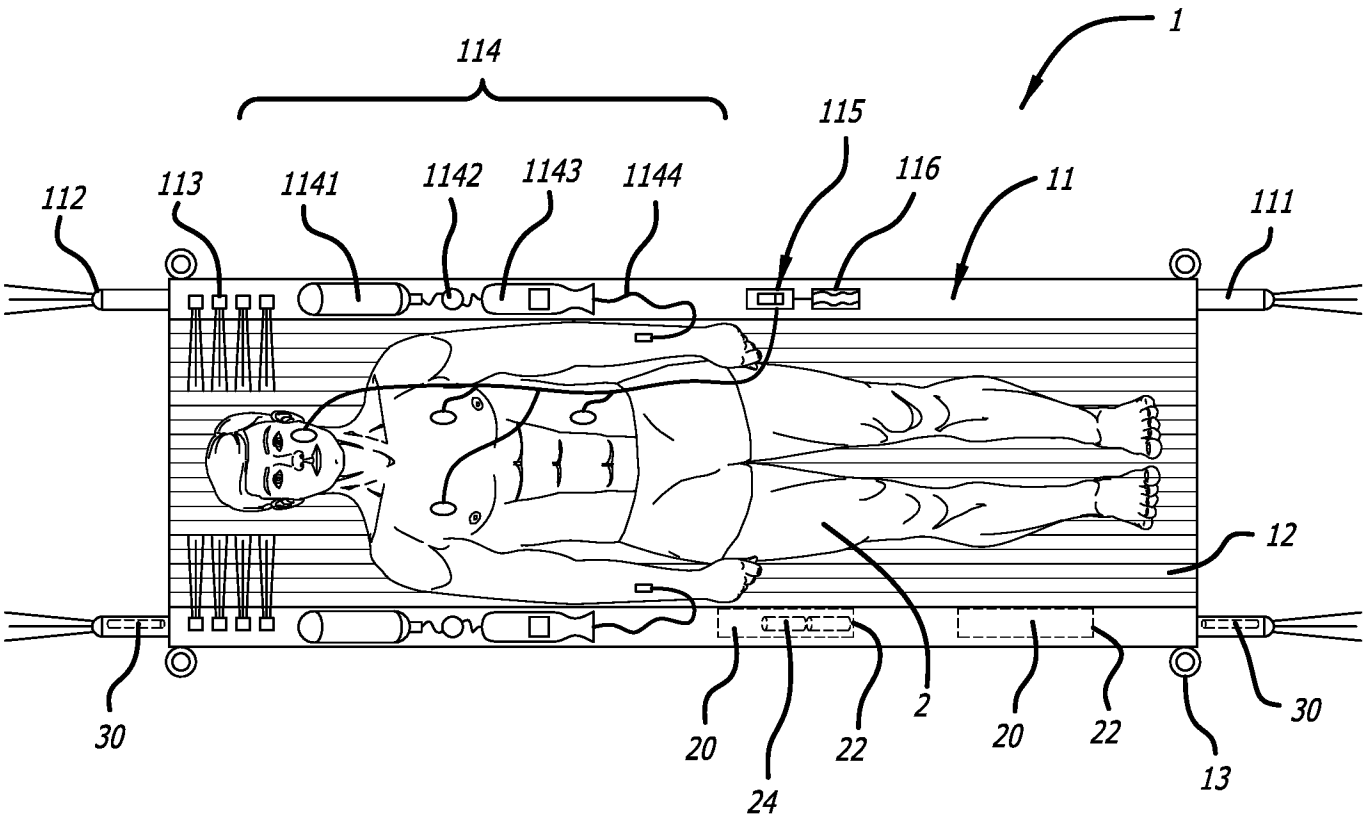

| | | | | |
|---|---|---|---|---|
| 2009/0211026 | A1* | 8/2009 | Schoff | A61G 1/0237 5/600 |
| 2009/0313759 | A1* | 12/2009 | Wong | A61G 1/01 5/627 |
| 2011/0099717 | A1* | 5/2011 | Windauer | A61G 1/013 5/627 |
| 2013/0086748 | A1* | 4/2013 | Walter | A61G 1/013 5/627 |
| 2013/0145554 | A1* | 6/2013 | Cane | A61M 5/1417 5/626 |
| 2013/0150928 | A1* | 6/2013 | Walter | A61F 7/0097 607/96 |
| 2013/0168987 | A1* | 7/2013 | Valentino | A61G 1/04 296/20 |

* cited by examiner

MULTI-FUNCTIONAL STRETCHER

PRIORITY

This application is a U.S. national stage application of International Patent Application No. PCT/EP2017/064049, filed Jun. 8, 2017, which claims priority to Switzerland Patent Application No. 00729/16, filed Jun. 8, 2016, each of which is incorporated by reference in its entirety into this application.

FIELD OF THE INVENTION

The present invention relates to a multi-functional stretcher for transporting individuals requiring medical care.

BACKGROUND OF THE INVENTION

Stretchers are a central piece in emergency situations for rescue and transportation of injured, wounded or sick individuals. They are usually applied in multiple scenarios, after accidents, catastrophic zones, or combat areas. Normally, two to four bearers are carrying the stretcher with a patient for medical evacuation for example from the frontline. The transportation is often across rugged terrain or installed in an ambulance car or plane for transportation to a first aid station or hospital. The primary goals of stretchers are safe, fast and efficient transportation of injured individuals.

Despite the long history of use of stretchers, modifications on the form or on the material to optimize the stretchers were limited, such that conventional stretchers represent basically simple scaffolds consisting of bars with a lying surface.

SUMMARY OF THE INVENTION

Individuals in emergency or transportation situations being transported by stretchers often have various demands regarding medical care. However, the environment where said individuals are transported make the appropriate supply of medical care, for example infusions, and medical observation of the individual difficult. Personnel bearing the stretcher and taking care of the transported individual as well as available and transportable instrumentation or drugs on hand are usually limited.

It is therefore an object of the invention to provide a multi-functional stretcher which enables multiple different features, especially regarding medical care, in addition to mere transportation of individuals.

This object is achieved by the subject matter of the independent claim. Favorable embodiments are further defined by the dependent claims and in the disclosure of this document.

According to an aspect of the invention, the object is achieved by a stretcher for transporting individuals requiring medical care, comprising main bars and a collapsible lying surface arranged between the main bars, wherein the main bars comprise at least one accommodation compartment for accommodating medical instrumentation and/or drugs.

Accommodating the medical instrumentation and/or drugs in the main bars of the stretcher has the advantage that disturbing elements conventionally installed next to the patient on a rack or even in the hand of the bearers of the stretcher or another concomitant person can be eliminated. Thus the versatility and the reliability of the patient transportation can significantly be increased by integration of the instrumentation and/or drugs into the main bars of the stretcher resulting in a compact, multi-functional stretcher.

The main bars may each comprise at least one accommodation compartment 22 or only one of the main bars may comprise at least one accommodation compartment 22.

Preferably, the main bars are at least partially made of a carbon material, especially carbon reinforced polymer material.

Carbon material, especially carbon fiber reinforced polymer material, has the advantage of providing a high strength-to-weight ratio.

Optionally, the stretcher is assembled from multiple pieces which can be disassembled when the stretcher is not in use.

According to an embodiment, the stretcher is characterized in that the main bars are at least partially hollow tubes containing the at least one compartment.

The main bars are preferably designed at least partially hollow in such a manner that the weight of the main bars can be kept small by maintaining a sufficient stability to ensure safe transportation of the individual on the stretcher.

Preferably, the main bars comprise at least one door 20 and/or at least one opening which allow access to the at least one accommodation compartment 22. Especially, cablings and/or tubes may be connected to the medical instrumentation arranged in the compartments through the at least one opening. The at least one door 20 may be used to insert a battery 24 and to exchange the battery or remove the battery for recharging.

Preferably, the main bars comprise handles at the ends of the main bars. The handles can have a reduced diameter compared to the main bars in order to facilitate the grip for the bearers of the stretcher.

According to an embodiment, the stretcher is characterized in that the main bars comprise lighting devices.

According to an embodiment, the stretcher is characterized in that the stretcher comprises first lighting devices arranged at an end of the lying surface for illuminating the head of the transported individual.

Preferably, the first lighting devices are arranged at an end of the main bars for illuminating the head of the transported individual.

The environment in which the individuals are transported by a stretcher can often exhibit poor lighting conditions, for example if transportation occurs at night. Lighting devices which illuminate the head of the individual is therefore particularly advantageous such that the individual can continuously be observed during transportation. Preferably, the lighting devices illuminating the head of the transported individual shine in oblique directions such that the individual on the stretcher is not getting blinded.

According to an embodiment, the stretcher is characterized in that the stretcher comprises second lighting devices arranged at the lower area of the main bars for illuminating the ground or at the ends of the main bars.

For transportation in difficult terrain, lighting devices illuminating the ground increase the safety for the bearers of the stretcher.

According to an embodiment, the stretcher is characterized in that the main bars are at least partially coated with a luminescent material.

Coating the main bars with luminescent material has the advantage that the stretcher may be visible during transportation without consuming power from a power source. For example the stretcher may be coated by fluorescent or phosphorescent material which glows after being illuminated by an external light source.

According to an embodiment, the stretcher is characterized in that the at least one compartment comprises an infusion system, the infusion system comprising pumps or gas patrons.

The at least one compartment may be designed in such a manner that conventional infusion systems (for example Infusomat® Space from B. Braun) can be placed inside the compartment. Integrating the infusion system into the main bars of the stretcher has the advantage that separate racks for the infusion system or even manually carrying the infusion system by the bearer can be avoided.

Preferably, the infusion system comprises bags or a syringe infusion device with an infusion line connected thereto.

In an embodiment, the at least one compartment comprises supply reservoirs with physiologic salt solutions and/or blood bottles.

According to an embodiment, the stretcher is characterized in that the main bars comprise self-warming elements arranged at the ends of the main bars.

According to an embodiment, the main bars comprise heating elements 30 arranged at the ends of the main bars.

Warming the ends of the main bars has the advantage that the hands of the bearers of the stretcher can be kept warm during transportation.

According to an embodiment, the stretcher is characterized in that the stretcher comprises an independent power supply, preferably arranged in one of the main bars.

The power supply can be used for example to power the infusion system and/or the lighting devices and/or other medical instrumentation integrated in the main bars of the stretcher. The power supply may power the heating elements. The power supply may be a battery. The battery may be rechargeable.

Optionally, the main bars comprise a sensor system for measurement of vital parameters, the sensor system preferably being arranged inside the at least one accommodation compartment. The compartment may comprise apertures to connect the probes of the vital sensors to the sensor system. The sensor system may be powered by the independent power supply.

Optionally, at least one of the main bars comprise a monitor being connected to the sensor system for measurement of vital parameters. The monitor and/or the sensor system may be connectable to a handheld device, especially a mobile phone or a wrist watch.

According to an embodiment, the stretcher comprises a belt apparatus for carrying the stretcher.

LIST OF FIGURES

Figure 2:
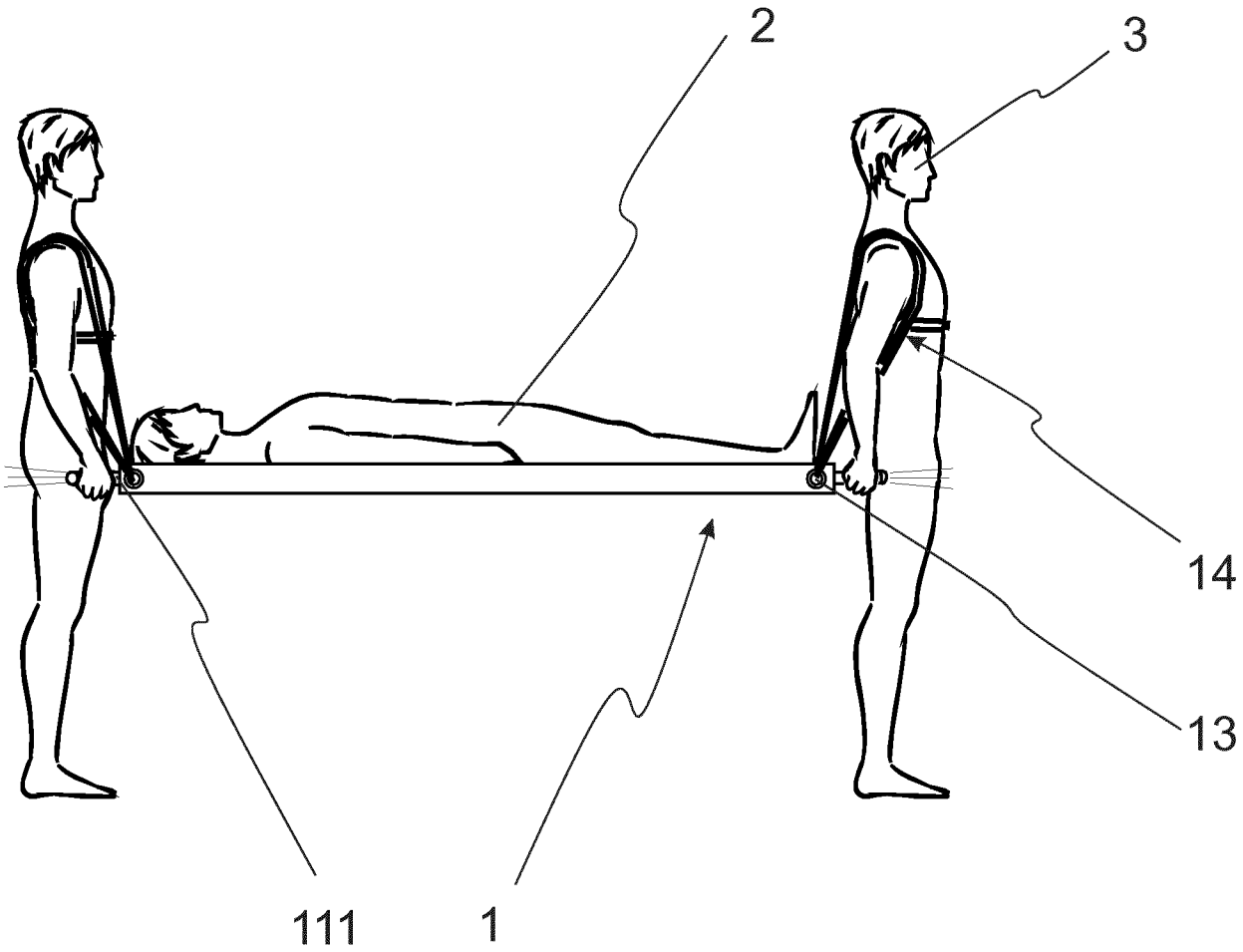

Embodiments of the invention will be better understood from the detailed description given herein below and the accompanying drawings. The drawings are showing:

FIG. 1 a top view of an embodiment of the stretcher with an individual;

FIG. 2 a side view of the stretcher according to FIG. 1 with two additional individuals bearing the stretcher.

DETAILED DESCRIPTION OF EXEMPLARY EMBODIMENTS

FIG. 1 shows a top view of an embodiment of the stretcher 1 according to the invention with an individual 2 lying on the stretcher 1. The stretcher 1 comprises two main bars 11 and a lying surface 12. The main bars 11 comprise handles 111 arranged at the ends of the main bars 11 and lamps 112 arranged at the ends of the handles 111. The main bars 11 are partially hollow tubes with an infusion system 114, a vital sensory system 115 and an integrated display device 116 arranged therein. The integrated display device 116 comprises additionally an optical and acoustical alarm device and monitors the data of the vital sensory system 115 to which the integrated display device 116 is connected to. The integrated display device 16 is preferably powered by an independent power supply integrated into the main bars 11. The infusion system 114 comprises a pressure device 1141 for infusion application, a pressure regulation device 1142, an infusion bag or syringe infusion device 1143 and an infusion cannula 1144. At an end of the main bars 11, near the head of the individual 2, there are arranged lamps 113 which illuminate the head of the individual 2. The lamps 113 are dimmed and light into an oblique direction and allow to monitor optically the status of the individual 2. Fixation holes 13 for a belt apparatus are arranged at the ends of the main bars 11.

FIG. 2 shows a side view of the stretcher 1 according to FIG. 1 with an individual 2 lying on the stretcher 1 and two bearers 3 bearing the stretcher 1 by gripping the handles 111. The bearers 3 bear the stretcher 1 with the help of a belt apparatus 14 with is attached both to the stretcher 1 by the fixation holes 13 and to the upper part of the body of the bearers 3. The belt apparatus 14 is vertically adjustable such that the space for the elbows of the bearers 3 can be optimized and the stretcher 1 may be adapted to the height of the bearers 3. The belt apparatus 14 comprises carbon hooks which are attached with ball joints. The hooks can engage with the fixation holes 13.

The invention claimed is:

1. A stretcher for transporting an individual requiring medical care, comprising:

a first main bar and a second main bar, wherein the first main bar and the second main bar are at least partially hollow tubes having a gripping section on each end, wherein the first main bar and the second main bar comprise:

at least one accommodation compartment for accommodating medical instrumentation and/or drugs;

at least one door which allows access to the at least one accommodation compartment; and an infusion system positioned inside the at least one accommodation compartment, wherein the infusion system comprises pumps or gas patrons; and a collapsible lying surface attached to and extending between the first main bar and the second main bar along substantially an entire length of each of the first main bar and the second main bar.

2. The stretcher according to claim 1, wherein the first main bar and the second main bar comprise lighting devices.

3. The stretcher according to claim 2, wherein the lighting devices comprise first lighting devices arranged at an end of the lying surface for illuminating the head of the individual requiring medical care.

4. The stretcher according to claim 3, wherein the first lighting devices are arranged at respective ends of the first main bar and the second main bar.

5. The stretcher according to claim 4, wherein the lighting devices further comprise second lighting devices arranged at lower areas of the first main bar and the second main bar for illuminating a ground under the stretcher or at the respective ends of the first main bar and the second main bar.

6. The stretcher according to claim 1, wherein the first main bar and the second main bar are at least partially coated with a luminescent material.

7. The stretcher according to claim 1, wherein the first main bar and the second main bar comprise heating elements arranged at the respective ends of the first main bar and the second main bar.

8. The stretcher according to claim 1, wherein the stretcher further comprises an independent power supply arranged in one of the first main bar and the second main bar.

9. The stretcher according to claim 8, wherein the independent power supply is a rechargeable battery.

10. The stretcher according to claim 1, wherein the stretcher comprises a belt apparatus for carrying the stretcher.

11. The stretcher according to claim 1, wherein the first main bar and the second main bar are at least partially made of a carbon reinforced polymer material.

12. The stretcher according to claim 1, wherein the gripping section on each end of the first main bar and the second main bar includes a handle.

13. The stretcher according to claim 1, wherein the first main bar and the second main bar further comprise a sensor system for measurement of vital parameters, the sensor system arranged inside the at least one accommodation compartment.

14. The stretcher according to claim 13, wherein the first main bar and the second main bar further comprise a monitor connected to the sensor system.

15. A stretcher for transporting individuals requiring medical care, comprising:

a first main bar and a second main bar, wherein the first main bar and the second main bar are at least partially hollow tubes having a gripping section on each end, wherein the first main bar and the second main bar comprise:

at least one accommodation compartment for accommodating medical instrumentation and/or drugs;

at least one door which allows access to the at least one accommodation compartment;

an infusion system positioned inside the at least one accommodation compartment; and a sensor system for measurement of vital parameters, the sensor system arranged inside the at least one accommodation compartment; and a collapsible lying surface attached to and extending between the first main bar and the second main bar along substantially an entire length of each of the first main bar and the second main bar.

16. The stretcher according to claim 15, wherein the first main bar and the second main bar further comprise a monitor connected to the sensor system.

* * * * *